US012709949B2

(12) United States Patent
Nease et al.

(10) Patent No.: US 12,709,949 B2
(45) Date of Patent: Aug. 18, 2026

(54) SINKER BAR WITH CENTRALIZER

(71) Applicants: Percheron Manufacturing, Odessa, TX (US); 360 Research Labs, LLC, Midland, TX (US)

(72) Inventors: Mark A. Nease, Odessa, TX (US); Clois L. Montague, Odessa, TX (US)

(73) Assignees: Percheron Manufacturing, Odessa, TX (US); 360 Research Labs, LLC, Midland, TX (US)

( * ) Notice: Subject to any disclaimer, the term of this patent is extended or adjusted under 35 U.S.C. 154(b) by 0 days.

(21) Appl. No.: 19/306,781

(22) Filed: Aug. 21, 2025

(65) Prior Publication Data

US 2026/0139554 A1 May 21, 2026

Related U.S. Application Data

(60) Provisional application No. 63/721,191, filed on Nov. 15, 2024.

(51) Int. Cl.
*E21B 17/10* (2006.01)
*E21B 43/12* (2006.01)

(52) U.S. Cl.
CPC ..... *E21B 17/1078* (2013.01); *E21B 43/127* (2013.01)

(58) Field of Classification Search
CPC ..... E21B 17/10–1078; E21B 43/128
See application file for complete search history.

(56) References Cited

U.S. PATENT DOCUMENTS 3,174,546 A * 3/1965 Flickinger ..... E21B 33/134 166/308.1
9,869,135 B1 * 1/2018 Martin ..... E21B 17/042
2012/0145410 A1 * 6/2012 Levie ..... B29C 45/14598 166/241.6

* cited by examiner

*Primary Examiner* — Kristyn A Hall
(74) *Attorney, Agent, or Firm* — Vorys, Sater, Seymour and Pease LLP

(57) ABSTRACT

A sinker bar with centralizer includes a cylindrical body having an outer surface and opposing first and second ends, one or more grooves defined in the outer surface between the first and second ends and thereby defining a grooved portion of the body, and a centralizer attached to the body at the grooved portion and encapsulating the one or more grooves, the centralizer providing opposing first and second centralizer ends extending axially beyond opposing axial ends of the grooved portion.

20 Claims, 12 Drawing Sheets

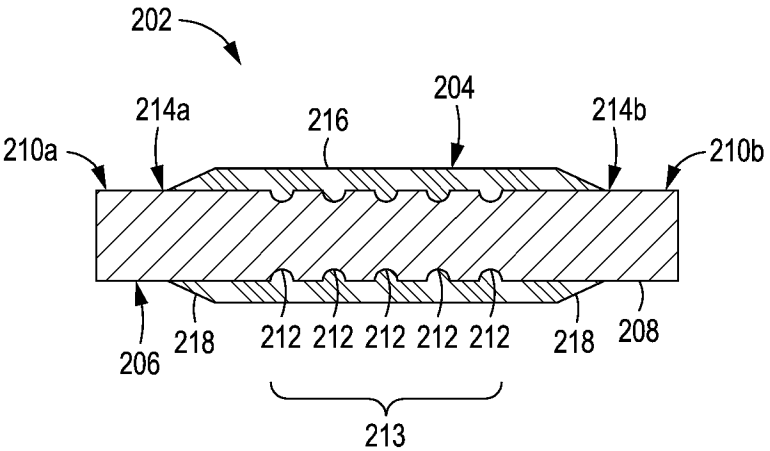
FIG. 2A (2)
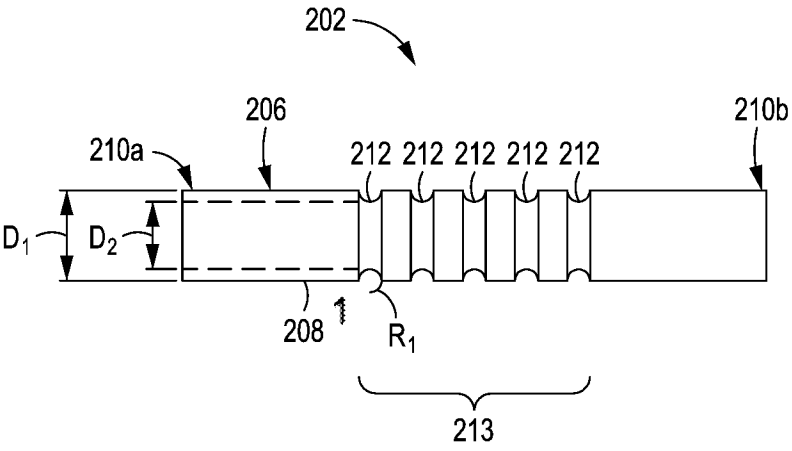
FIG. 2A (1)
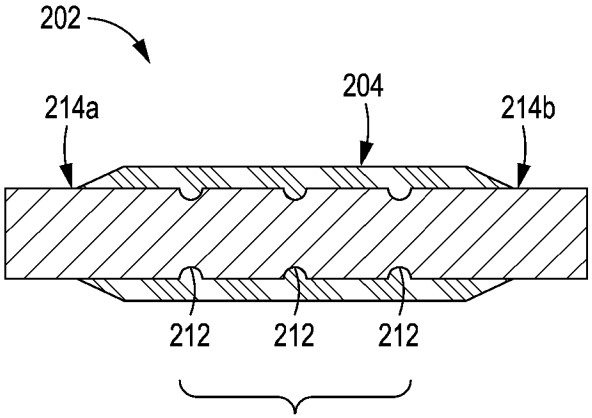
FIG. 2B (2)
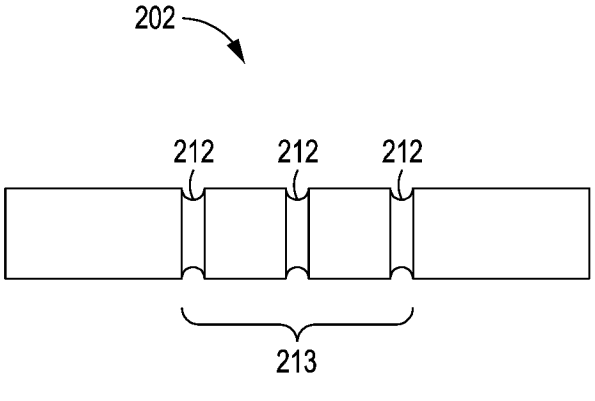
FIG. 2B (1)

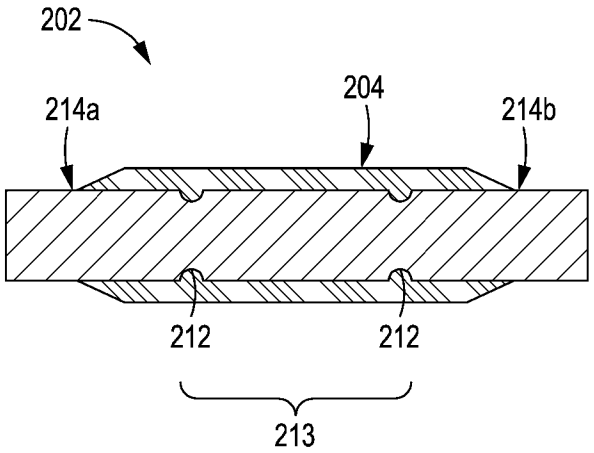
FIG. 2C (2)
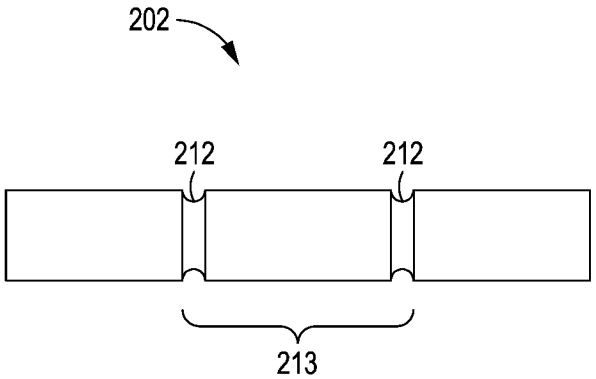
FIG. 2C (1)
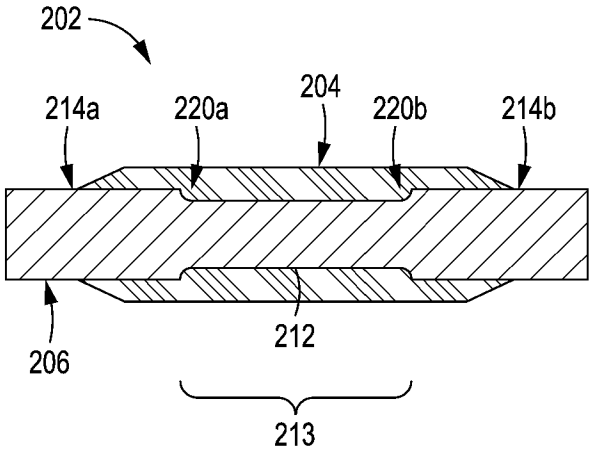
FIG. 2D (2)
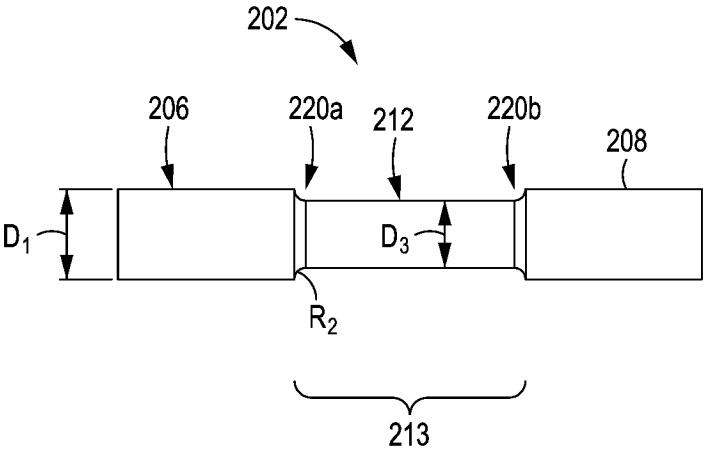
FIG. 2D (1)

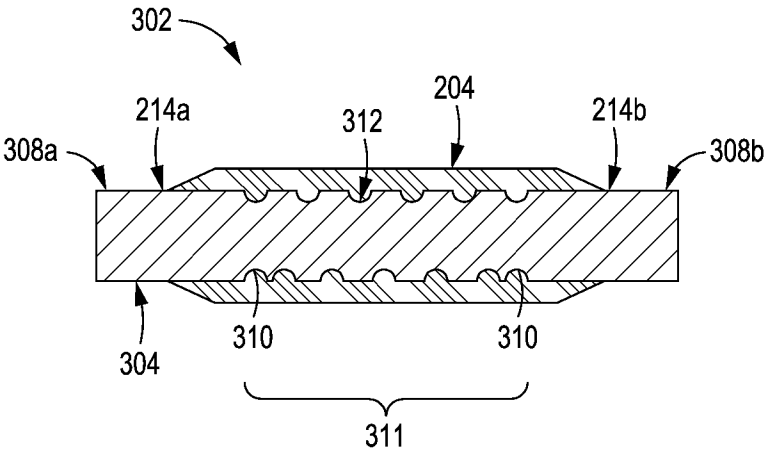
FIG. 3A (2)
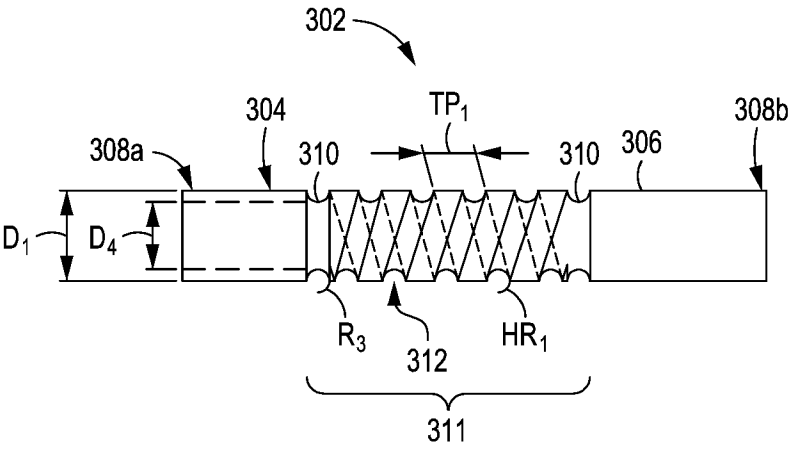
FIG. 3A (1)
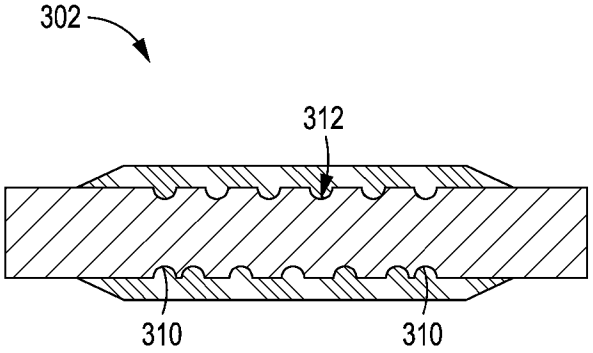
FIG. 3B (2)
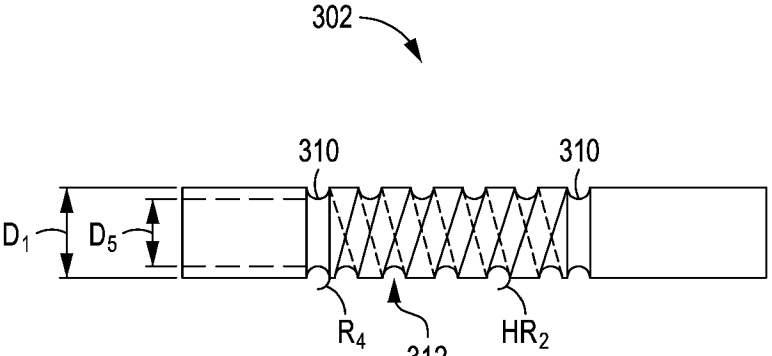
FIG. 3B (1)

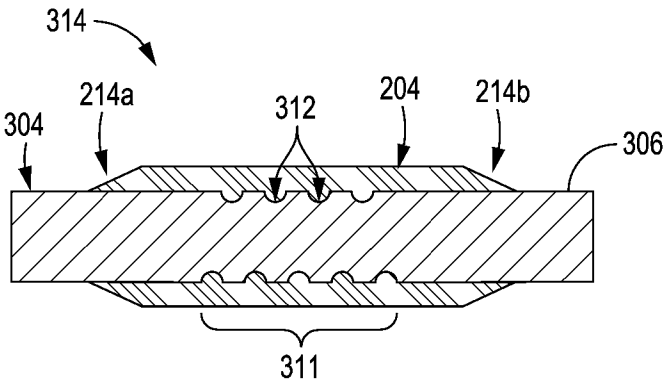
FIG. 3C (2)
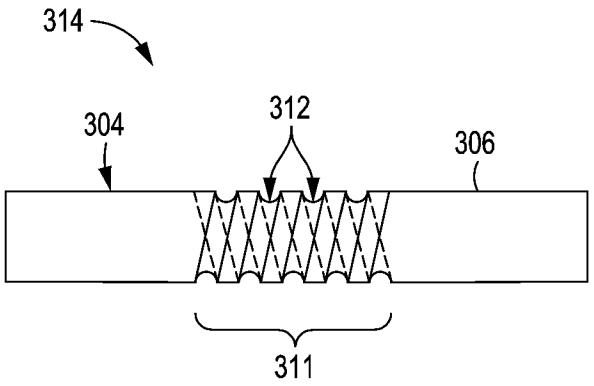
FIG. 3C (1)
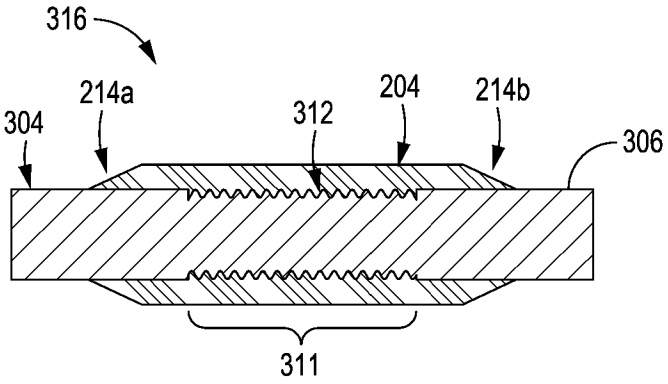
FIG. 3D (2)
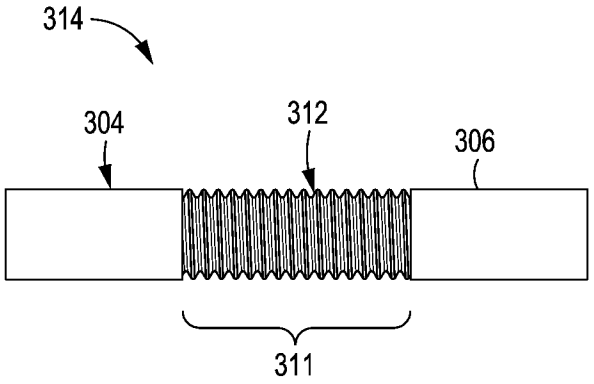
FIG. 3D (1)

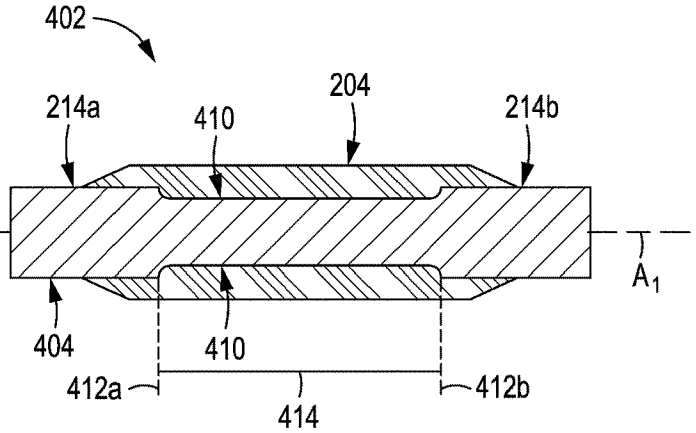
FIG. 4A (2)
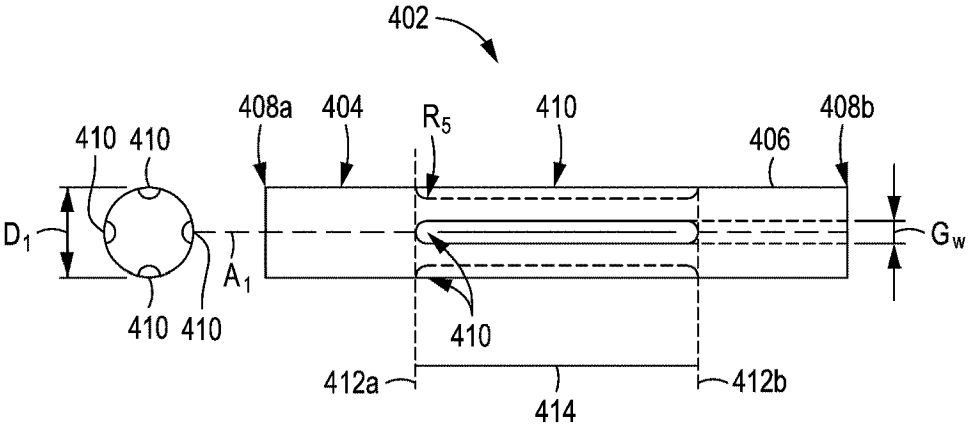
FIG. 4A (1)
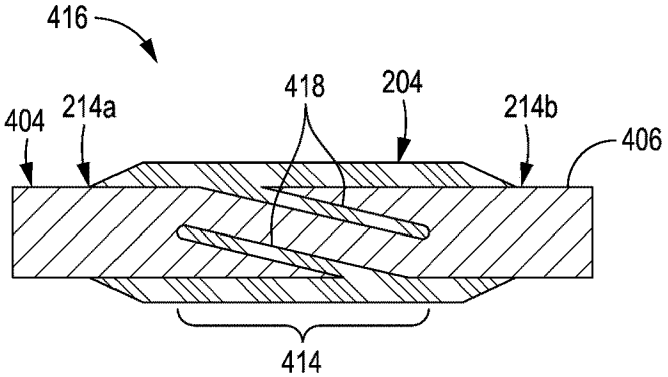
FIG. 4B (2)
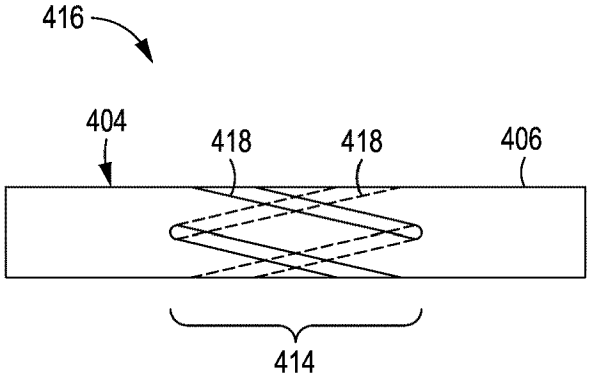
FIG. 4B (1)

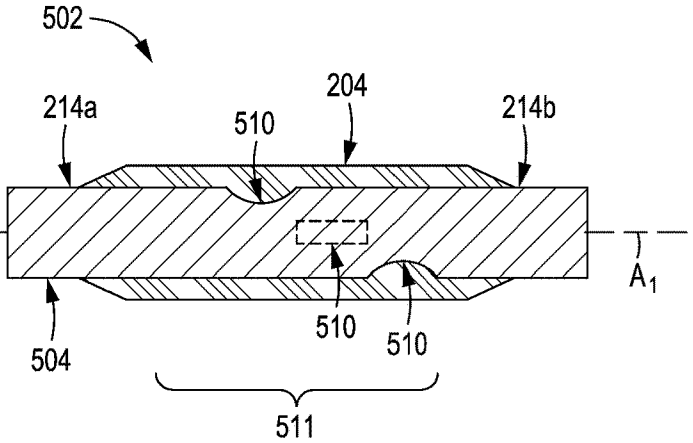
FIG. 5A (2)
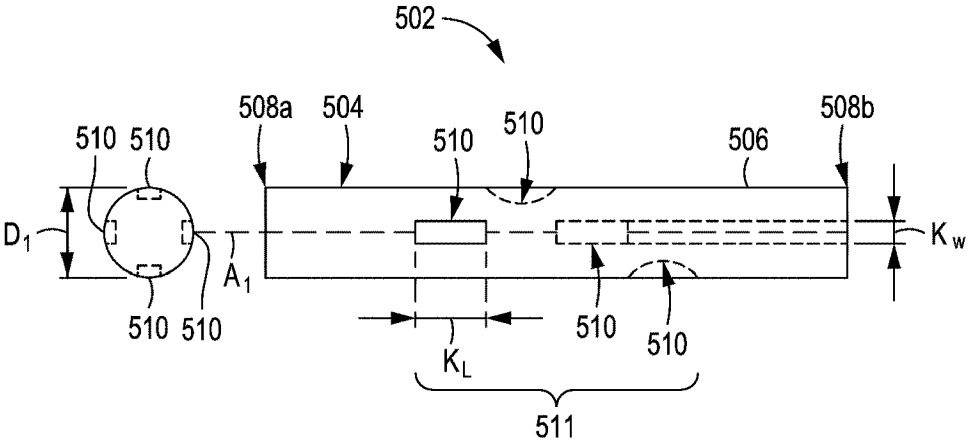
FIG. 5A(1)
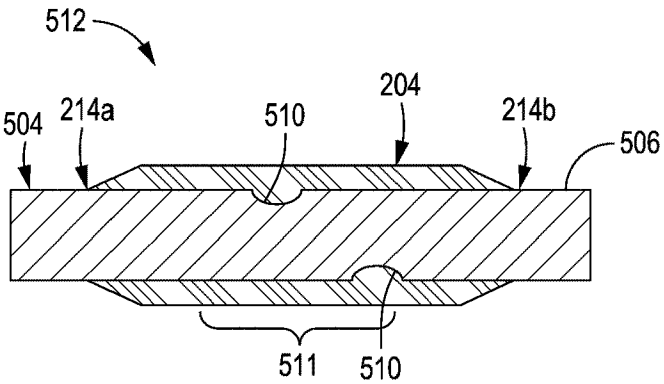
FIG. 5B (2)
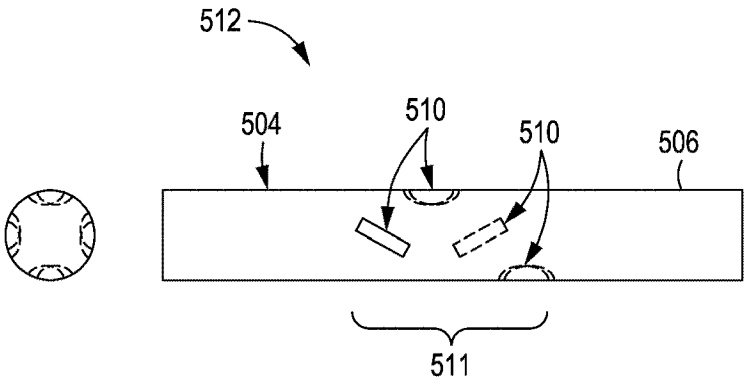
FIG. 5B (1)

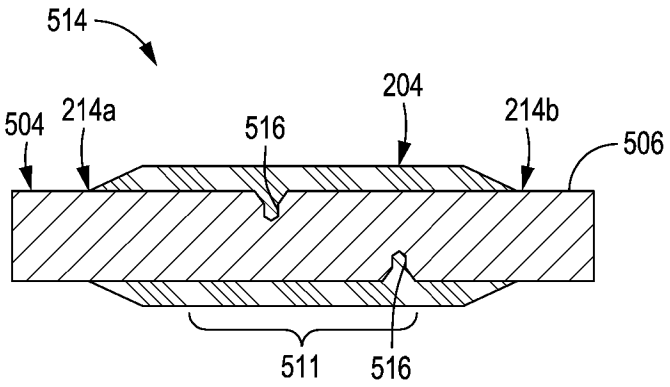
FIG. 5C (2)
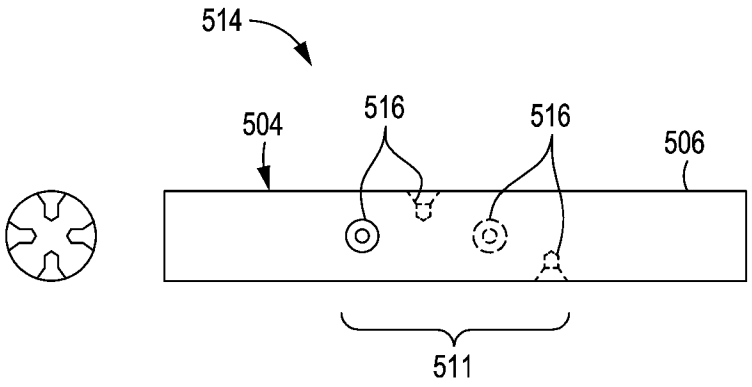
FIG. 5C (1)

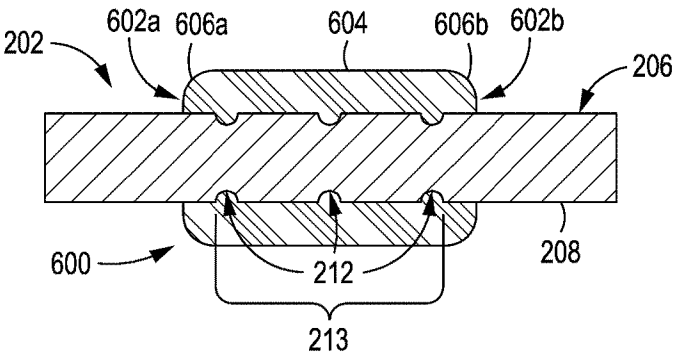
FIG. 6A (2)
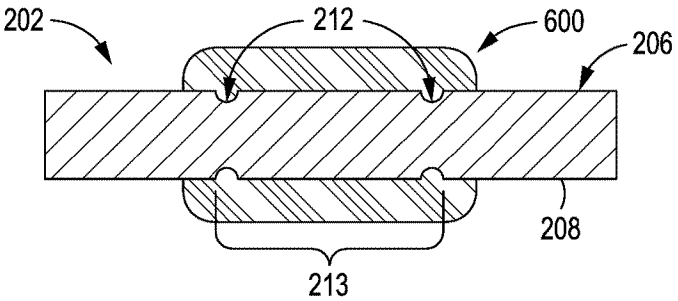
FIG. 6B (2)
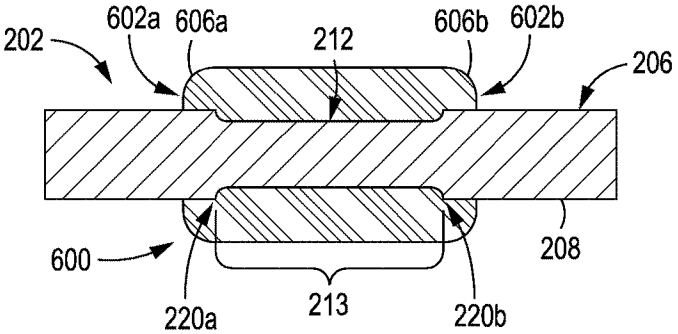
FIG. 6C(2)
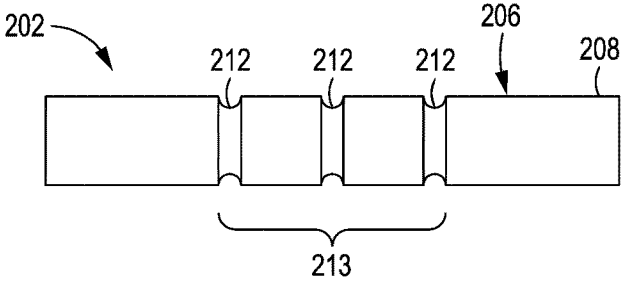
FIG. 6A(1)
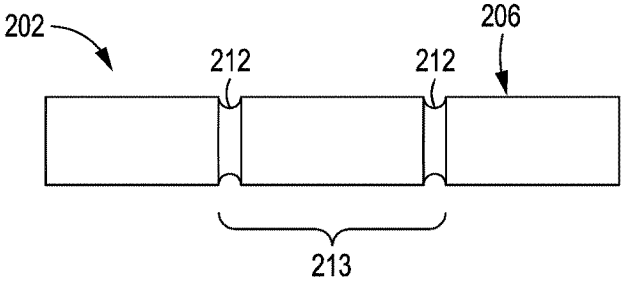
FIG. 6B(1)
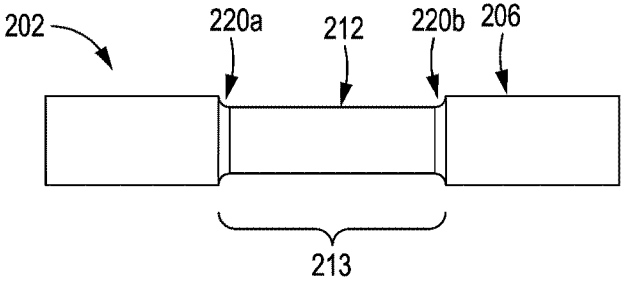
FIG. 6C(1)

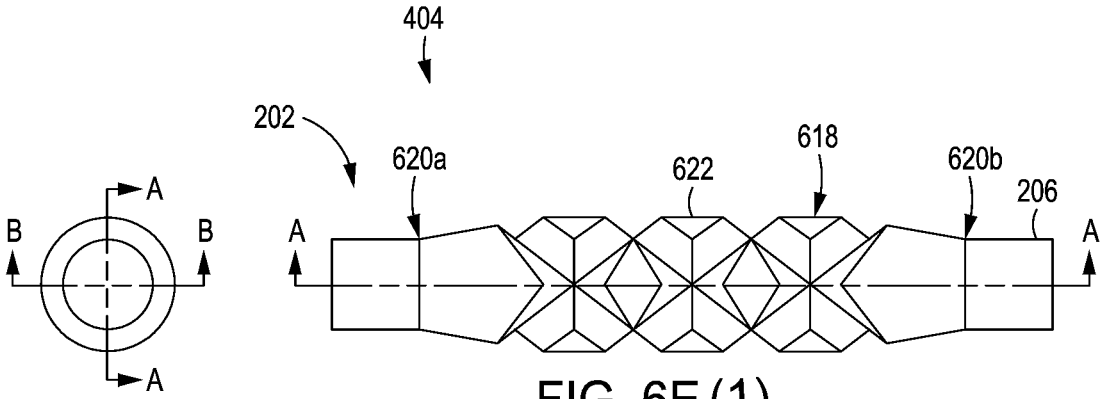
FIG. 6E (1)
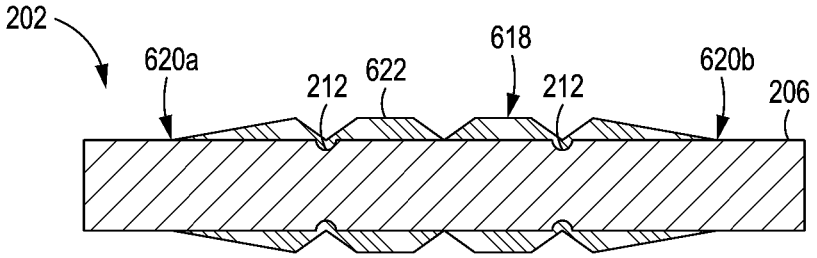
SECTION A-A
FIG. 6E (2)
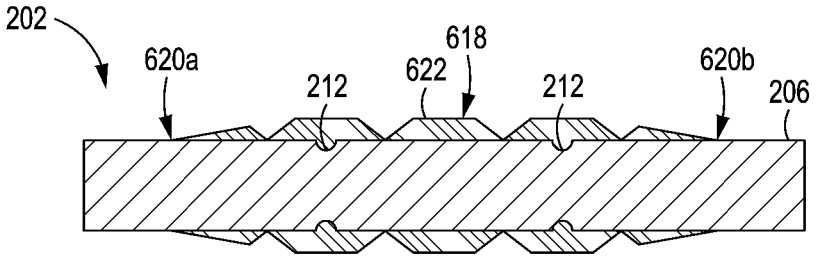
SECTION B-B
FIG. 6E (3)

SINKER BAR WITH CENTRALIZER

BACKGROUND

In the oil and gas industry, a sinker bar is a commonly utilized rod string component that is deployed to add weight to a rod string in pumpjack systems. Added weight may be desirable for a number of reasons, such as overcoming downhole wellbore pressure, greater ease and efficiency in extending the rod string into the wellbore (or production tubing arranged within the wellbore), and adding tension and/or rigidity to the rod string. An operator may add any number of sinker bars to the rod string that is procedurally desirable for the respective operation.

Typical sinker bars are thicker in diameter as compared to the sucker rods of pumpjack rod strings, and are designed to bear most of the stresses occurring at the downhole end of oil and gas pumping systems. These forces include tensile forces from the weight of the sinker bar, friction and shear stress from engagement with the inner walls of the production tubing, and downhole wellbore pressure.

Improvements to sinker bars and sinker bar designs are desirable to help reduce costs and improve efficiency.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

FIGS. 2A(1) and 2A(2) are juxtaposed side and corresponding cross-section views of an example sinker bar.

FIGS. 2B(1) and 2B(2) are juxtaposed side and corresponding cross-section views of another example sinker bar, according to one or more additional embodiments.

FIGS. 2C(1) and 2C(2) are juxtaposed side and corresponding cross-section views of another example sinker bar, according to one or more additional embodiments.

FIGS. 2D(1) and 2D(2) are juxtaposed side and corresponding cross-section views of another example sinker bar, according to one or more additional embodiments.

FIGS. 3A(1) and 3A(2) are juxtaposed side and corresponding cross-section views of an additional example sinker bar.

FIGS. 3B(1) and 3B(2) are juxtaposed side and corresponding cross-section views of another example sinker bar, according to one or more additional embodiments.

FIGS. 3C(1) and 3C(2) are juxtaposed side and corresponding cross-section views of another example sinker bar, according to one or more additional embodiments.

FIGS. 3D(1) and 3D(2) are juxtaposed side and corresponding cross-section views of another example sinker bar, according to one or more additional embodiments.

FIGS. 4A(1) and 4A(2) are juxtaposed side and corresponding cross-section views of an additional example sinker bar.

FIGS. 4B(1) and 4B(2) are juxtaposed side and corresponding cross-section views of another example sinker bar, according to one or more additional embodiments.

FIGS. 5A(1) and 5A(2) are juxtaposed side and corresponding cross-section views of an additional example sinker bar.

FIGS. 5B(1) and 5B(2) are juxtaposed side and corresponding cross-section views of another example sinker bar, according to one or more additional embodiments.

FIGS. 5C(1) and 5C(2) depict juxtaposed side and cross-sectional side views of another example sinker bar, according to one or more additional embodiments of the present disclosure.

FIGS. 6A(1) and 6A(2) are juxtaposed side and corresponding cross-section views of another example sinker bar related to FIGS. 2B(1) and 2B(2).

FIGS. 6B(1) and 6B(2) are juxtaposed side and corresponding cross-section views of another example sinker bar, according to one or more additional embodiments.

FIGS. 6C(1) and 6C(2) are juxtaposed side and corresponding cross-section views of another example sinker bar, according to one or more additional embodiments.

FIGS. 6E(1)-6E (3) illustrate an additional example of a centralizer that may be used in accordance with the present disclosure.

DETAILED DESCRIPTION

Embodiments in accordance with the present disclosure generally relate to pumpjack sinker bars used in the oil and gas industry and, more particularly, to sinker bars that include a centralizer.

The sinker bar designs described herein include a centralizer component or "centralizer" that helps center the sinker bar and axially adjacent downhole components within a wellbore, thereby also helping to prevent the accumulation of stresses in the sinker bar. Inclusion of the centralizer also prevents wear in the production tubing. As described herein, the sinker bar may define one or more grooves, and the centralizer may be attached to the sinker bar at the location of the grooves, thereby providing a more robust attachment with the sinker bar. In some embodiments the material of the centralizer may extend past the axial ends (extents) of the one or more grooves, and may further provide transition surfaces that terminate flush with the outer surface of the sinker bar. Advantageously, sinker bars with centralizers can be added to a rod string without devaluing the overall weight advantage, which occurs when guided sucker rods of less density per foot are substituted for guided sinker bars, i.e., sinker bars with centralizers.

Figure 1:
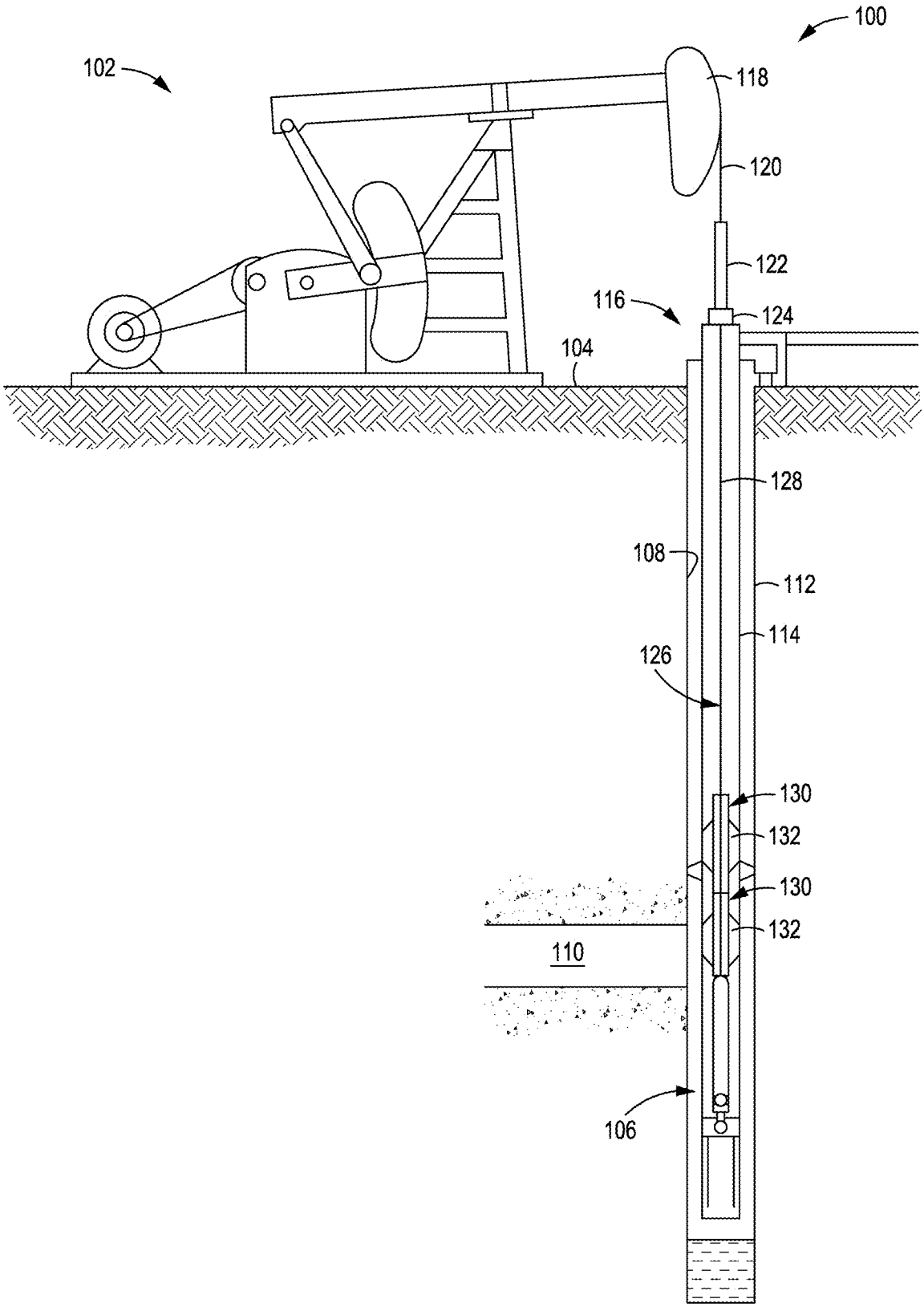
FIG. 1 is a schematic diagram of an example well system that can incorporate the principles of the present disclosure.

FIG. 1 is a schematic view of an example well system 100 that may employ the principles of the present disclosure. As illustrated, the well system 100 includes a pumping unit 102 positioned at a well surface 104. The pumping unit 102 is known in the industry by many names, including, but not limited to, a "pumpjack," a "nodding donkey pump," and a "horsehead pump," and is configured to drive (operate) a submersible pump 106 arranged within a wellbore 108. As shown, the wellbore 108 extends vertically into a subterranean formation and penetrates a hydrocarbon-bearing reservoir 110. The wellbore 108 may be lined with casing 112 that extends to (or toward) the bottom (most distal end) of the wellbore 108. A string of production tubing 114 extends from a wellhead 116 and is concentrically arranged within the casing 112. The production tubing 114 terminates at a predetermined distance from the bottom of the wellbore 108.

As illustrated, the pumping unit 102 includes a horse head 118 to which a cable 120 (alternately referred to as a "bridle") is attached. A polished rod 122 is attached to the distal end of the cable 120 and extends through a stuffing box 124 forming part of the wellhead 116, which caps the wellbore 108. The polished rod 122 is reciprocated within the stuffing box 124 as the horse head 118 moves (reciprocates) up and down.

The polished rod 122 forms part of or is otherwise operatively coupled to a rod string 126, alternately referred to as a "sucker-rod string," extended into the wellbore 108. The rod string 126 may include a variety of components that enable pumping of hydrocarbons migrating into the wellbore 108 to the well surface 104 using the pumping unit 102. For example, the rod string 126 can include a series of sucker rods 128, the submersible pump 106 arranged at the distal end of the rod string 126, and one or more sinker bars 130 (two shown) interposing the series of sucker rods 128 and the submersible pump 106.

The sucker rods 128 are generally used to join the surface and downhole components and typically comprise steel and fiberglass rods between 25 and 30 feet in length with opposing threaded ends. In contrast, the sinker bars 130 comprise weighted components made of high-density materials and are generally used to maintain tension in the rod string 126. The sinker bars 130 typically have a larger outer diameter as compared to the sucker rods 128 and help overcome the effects of pressure and friction caused by the wellhead 116.

The sinker bar 130 may be operatively coupled to the submersible pump 106, either directly or indirectly. In some applications, one or more stabilizing components (not shown) may be included in the rod string 126 and interpose the submersible pump 106 and the sinker bar(s) 130. The sinker bar(s) 130 may be arranged within and operatively coupled to any matable component within the rod string 126. As the pumping unit 102 operates, the connected rod string 126 reciprocates (oscillates) up and down within the wellbore 108 and experiences various kinds of forces, such as tensile forces from the weight of the sinker bar(s) 130, and engagement with the inner walls of the production tubing 114. The combination of these forces may cause wear and eventual fracturing of the rod string and the other downhole components.

According to embodiments of the present disclosure, one or more of the sinker bars 130 may include a centralizer 132 coupled to the outer circumference of the sinker bar 130. The centralizer 132 helps prevent the outer surfaces of the sinker bar 130 from contacting the inner walls of the production tubing 114 as the rod string 126 oscillates up and down within the wellbore 108. The centralizer 132 is also operable to help centralize the corresponding sinker bar 130 and axially adjacent portions of the rod string 126 within the wellbore 108 (i.e., the production tubing 114), and thereby reduce wear on the rod string 126, the production tubing 114, and the submersible pump 106. As discussed below, one or more grooves may be defined on the outer circumference of the sinker bar 130, and the centralizer 132 may be attached to the sinker bar 130 at the grooves. The centralizer 132 may be made of a polymer or a molded plastic material that is either thermoformed or injection molded to the outer circumference. The molten plastic material can flow into the grooves and thereby help lock the centralizer in place while simultaneously providing a buffer around the circumference of the sinker bar 130.

While the sinker bars 130 are shown in FIG. 1 operating in a vertical orientation, it is contemplated herein that the sinker bars 130 also operate in horizontal wellbores or wellbores angled from vertical to any degree. In these applications, the centralizers 132 may prove especially advantageous in helping to reduce friction against the inner walls of the production tubing 114 as the rod string 126 reciprocates.

FIGS. 2A-2D depict juxtaposed side and cross-sectional side views of example sinker bars 202, according to multiple embodiments of the present disclosure. More specifically, in each of FIGS. 2A-2D the image on the left shows the sinker bar 202 without a corresponding centralizer 204, and the image on the right is a cross-sectional view of the sinker bar 202 with the centralizer 204 attached thereto. The sinker bar 202 may be the same as or similar to the sinker bar(s) 130 of FIG. 1, and therefore may be best understood with reference thereto. Accordingly, the sinker bar 202 may be arranged in (form part of) the rod string 126 (FIG. 1) and used as part of the well system 100 (FIG. 1).

Referring first to FIG. 2A, as illustrated, the sinker bar 202 comprises a cylindrical, solid body 206 having a generally smooth outer surface 208 and exhibiting an outer diameter $D_1$. In at least one embodiment, the outer diameter $D_1$ may be about 1.50 inches, but may be more or less than 1.50 inches, as governed by API required tolerances (i.e., +0.015, −0.030). In some embodiments, for example, the outer diameter $D_1$ may be about 1.125 inches, or could alternatively be about 2.00 inches.

The body 206 has opposing first and second ends 210*a* and 210*b*, and one or more grooves 212 are defined in the outer surface 208 between the opposing ends 210*a,b*. The grooves 212 are defined in the body 206 across a grooved portion 213 of the body 206, beyond which the outer surface 208 of the body 206 remains smooth. In the illustrated embodiment of FIG. 2A, five grooves 212 are defined in the body 206, but more or less than five grooves 212 may be included, as discussed in more detail below. In some embodiments, the grooves 212 may be equidistantly (evenly) spaced from each other along the grooved portion 213, but could alternatively be non-equidistantly spaced, without departing from the scope of the disclosure.

The grooves 212 can be defined in the outer surface of the body 206 via a variety of means including, but not limited to, machining, forging, chemical etching, electrochemical machining (ECM), laser cutting, plasma cutting, waterjet cutting, or any combination thereof.

As shown in FIG. 2A, the grooves 212 are defined circumferentially about the entire outer surface 208 of the body 206, thereby forming annular cutouts that are spaced from each other along the axial length of the body 206. In some embodiments, the grooves 212 may be parallel to each other and otherwise reside in parallel planes, but could alternatively be arranged at an angle offset from adjacent grooves 212 on either side. In some embodiments, each groove 212 exhibits the same diameter $D_2$, which is smaller than the diameter $D_1$ of the body 206. In other embodiments, however, one or more of the grooves 212 may exhibit a diameter different from one or more of the other grooves 212. In at least one embodiment, the inner diameter $D_2$ may be about 1.125 inches, but could be more or less than 1.125 inches.

One or more of the grooves 212 are defined in the outer surface 208 to exhibit a radius $R_1$. In some embodiments, each groove 212 exhibits the same radius $R_1$, but could alternatively exhibit a different radius. In at least one embodiment, the radius $R_1$ of the grooves 212 may be about 0.188 inches, but could be more or less than 0.188 inches, without departing from the scope of the disclosure. In yet other embodiments, the radius $R_1$ may be omitted.

Referring to cross-section of FIG. 2A, the centralizer 204 is attached to the body 206 at the location of the grooves 212 (e.g., along the grooved portion 213) and extends circumferentially about the body 206 such that it is arranged concentric with the body 206. More specifically, the centralizer 204 may be attached to the body 206 such that it covers and otherwise encapsulates the grooves 212. In some embodiments, the centralizer 204 may be made of a polymer or plastic material that is injection molded or thermoformed onto the outer surface 208 of the body 206. In such embodiments, and during the injection molding process, the molten polymer is able to flow into and solidify within the grooves 212. Flowing the polymer material into the grooves 212 may help axially secure the centralizer 204 to the body 206, which may provide a more robust and secure attachment as the polymer material cools and cures within the grooves 212.

Alternatively, or in addition to thermoforming the centralizer 204 onto the body 206, the centralizer 204 may be attached to the body 206 via other means including, but not limited to, an adhesive, mechanical fasteners (e.g., bolts, screws, rivets, etc.), an interference fit, a mechanical attachment, or any combination thereof.

As illustrated, the centralizer 204 provides opposing first and second centralizer ends 214*a* and 214*b*, and the centralizer 204 is situated on the body 206 such that the centralizer ends 214*a,b* extend axially past the grooved region 213, which extends between the first and last grooves 212 in the series of grooves 212. By extending past the grooved region 213, the centralizer 204 has a greater surface area for which to contact the inner walls of the production tubing 114 (FIG. 1). The load experienced by the centralizer 204 can then be distributed more uniformly along the axis of the body 206, enabled by the additional material of the centralizer 204 and thereby providing several advantages. First, because the grooves 212 have reduced cross section relative to the rest of the body 206, the average shear stress delivered to sinker bar 202 may be absorbed by a greater amount of material of the more resilient sinker bar body 206. Second, the centralizer 202 extending past the grooves 212 may reduce the amount of transverse shear loading along the axis of body 206 at the radii of grooves 212. Third, the additional material of the centralizer 204 increases the length of the adhesion area between the sinker bar 202 and the centralizer 204 and dissuades slippage between the centralizer 204 and the body 206, which may occur due to imperfect molding of the centralizer 204 into the grooves 212 or because of centralizer wear introduced at the grooves 212. Fourth, the sloping of the centralizer 202 beyond the grooves 212 eliminates 90° corners, as discussed in greater detail below. The foregoing advantages comprise a non-exhaustive list and should not be interpreted as limiting, for purposes of this disclosure.

Moreover, by extending the ends 214*a,b* of the centralizer 204 (axially) past the ends of grooved portion 213, a seal surface of a greater axial length is established between the outside surface 208 of the sinker bar 202 and the inside surface of the centralizer 204 to prevent downhole contaminants from reaching and settling in the reduced diameter areas (e.g., the grooves 212). This may prevent corrosion-related failures from occurring by preventing contaminants from entering and from being trapped in the most vulnerable sections of the of the sinker bar 202.

In addition, extending the ends 214*a,b* of the centralizer 204 (axially) past the axial ends of grooved portion 213 of the sinker bar 202 may afford greater ease in attaching the centralizer 214 to the body 206 by eliminating the need to precisely align the centralizer 204 with the grooves 212 while applying the centralizer 204 material. The additional length or "overhang" of the ends 214*a,b* of the centralizer 204, in relationship to the ends of the grooves 212, eliminates the tight positioning/alignment tolerances that may be required when applying centralizers (guides) with axial lengths equal to the axial length of the grooved portion 213. Moreover, extending the ends 214*a,b* of the centralizer 204 (axially) past the axial ends of grooved portion 213 may also greatly reduce or totally eliminate the possibility of the centralizer 204 inadvertently being shorter than the grooved portion 213, hence eliminating the undesirable possibility of the reduced diameter section of the sinker bar 202 being directly exposed to downhole contaminants.

The centralizer 204 further provides an outer radial surface 216 engageable with the inner wall of the production tubing 114 (FIG. 1) when the sinker bar 202 is in the wellbore 108 (FIG. 1). In some embodiments, the outer radial surface 216 extends parallel to the outer surface 208 of the body 206. At the opposing centralizer ends 214*a,b*, the centralizer 204 may transition from the outer radial surface 216 to opposing transition surfaces 218 that transition until becoming flush with the outer surface 208 of the body 206. In the illustrated embodiment, the transition surfaces comprise angled or "sloped" surfaces, but could exhibit other geometries, without departing from the scope of the disclosure. The transition surfaces 218 terminate past (outside of) the first and last grooves 212. In some embodiments, as illustrated, the transition surfaces 218 may be generally straight, but, as provided below, could alternatively be curved or arcuate (e.g., exhibit a radius), or may progressively vary in the axial direction, without departing from the scope of the disclosure.

FIGS. 2B and 2C depict additional example embodiments of the sinker bar 202. Unlike the sinker bar 202 of FIG. 2A, the sinker bar 202 in FIG. 2B only includes three grooves 212 and the sinker bar 202 in FIG. 2C only includes two grooves 212. In both embodiments, the opposing centralizer ends 214*a* and 214*b* of the centralizer 204 extend axially past the grooved portion 213.

FIG. 2D is another example embodiment of the sinker bar 202, according to one or more additional embodiments of the present disclosure. Unlike the sinker bars 202 of FIGS. 2A-2C, the sinker bar 202 in FIG. 2D includes only a single groove 212 providing opposing first and second groove ends 220*a* and 220*b*. The groove 212 may exhibit an outer diameter $D_3$ that is smaller than the outer diameter $D_1$ of the body 206. In some embodiments, the outer diameter $D_3$ may be the same as the outer diameter $D_2$ of the grooves 212 in FIGS. 2A-2C, but could alternatively be greater or less than the outer diameter $D_2$.

As illustrated, the groove 212 may be an elongated groove extending between the groove ends 220*a,b* such that the groove 212 defines the grooved portion 213. In some embodiments, the groove 212 may exhibit the outer diameter $D_3$ between the groove ends 220*a,b*. In other embodiments, however, the groove 212 may exhibit two or more different diameters between the groove ends 220*a,b*. In such embodiments, a portion of the groove 212 may exhibit the outer diameter $D_3$, but another portion of the groove 212 may exhibit a diameter that is greater or less than $D_3$, but less than $D_1$, such that two or more sections of the groove 212 exhibiting two or more different diameters extend between the groove ends 220*a,b*.

In some embodiments, the groove ends 220*a,b* provide an angled transition (e.g., 90°, 45°, etc.) to the outer surface 208 of the body 206. In other embodiments, however, one or both of the groove ends 220*a,b* may be curved or arcuate and exhibit a radius $R_2$. In some embodiments, each groove end 220*a,b* exhibits the same radius $R_2$, but could alternatively exhibit a different radius. In at least one embodiment, the radius $R_2$ of the grove ends 220*a,b* may be the same as the radius $R_1$ of the grooves 212 in FIGS. 2A-2C.

The sinker bar 202 in FIG. 2D includes the centralizer 204 attached to the body 206 at the groove 212, and the centralizer 204 extends circumferentially about the body 206 such that it is arranged concentric with the body 206. Moreover, the centralizer 204 is attached to the body 206 such that it covers and otherwise encapsulates the groove 212 and extends past the opposing groove ends 220*a,b* of the groove 212. More specifically, the opposing centralizer ends 214*a,b* extend axially past the grooved portion 213, thereby fully encapsulating the groove 212.

FIGS. 3A and 3B show juxtaposed side and cross-sectional side views of another example sinker bar 302, according to one or more additional embodiments of the present disclosure. The sinker bar 302 may be the same as or similar to the sinker bar 130 of FIG. 1, and therefore may be best understood with reference thereto. Accordingly, the sinker bar 302 may be arranged in (form part of) the rod string 126 (FIG. 1) and used as part of the well system 100 (FIG. 1).

As shown in FIG. 3A, the sinker bar 302 comprises a cylindrical, solid body 304 having a generally smooth outer surface 306 and exhibits an outer diameter $D_1$. The body 306 has opposing first and second ends 308*a* and 308*b*, and a plurality of grooves are defined in the outer surface 306 between the ends 308*a,b*. In the illustrated embodiment, the grooves include two annular end grooves 310 located at opposing ends of the grooves, and a helical groove 312 extending between the annular end grooves 310.

The annular end grooves 310 are defined circumferentially about the entire outer surface 306 of the body 304, thereby forming annular cutouts spaced from each other along the length of the body 304. The end grooves 310 are defined in the body 304 and located in a grooved portion 311 of the body 304, beyond which the outer surface 306 of the body 304 is smooth. In some embodiments, the end grooves 310 are parallel to each other and otherwise reside in parallel planes, but could alternatively be arranged at an angle offset from opposing annular groove 310. In some embodiments, each end groove 310 exhibits the same diameter $D_4$, which is smaller than the diameter $D_1$ of the body 304.

In some embodiments, each end groove 310 exhibits the same radius $R_3$, but the end grooves 310 may alternatively exhibit different radii. In at least one embodiment, the radius $R_3$ of the end grooves 310 may be about 0.125 inches, but could be more or less than 0.125 inches, without departing from the scope of the disclosure.

The end grooves 310 may define the beginning and end points of the helical groove 312. The helical groove 312 may be similar in some respects to the end grooves 310, but extends about the circumference of the body 304 helically between the end grooves 310. In some embodiments, two or more helical grooves 312 may be defined in the body 304 and extend between the end grooves 310.

The helical groove 312 extends about the body 304 between the opposing annular end grooves 310 at a constant thread pitch $TP_1$. In at least one embodiment, the thread pitch $TP_1$ may be about 0.75 inches, but may be more or less than 0.75 inches. In another embodiment, thread pitch $TP_1$ may change (vary) along the length of body 304, thereby defining a variable thread pitch. It will be appreciated by one having ordinary skill in the art that the helical groove 312 may begin or end from either the top or bottom portions of either end groove 310.

Still referring to FIG. 3A, the centralizer 204 is attached to the body 304 at the grooves 310, 312 and extends circumferentially about the body 304 such that it is arranged concentric with the body 304. More specifically, the centralizer 204 may be attached to the body 304 such that it covers and otherwise encapsulates the grooves 310, 312. Moreover, the opposing first and second centralizer ends 214*a,b* extend axially past the grooved portion 311.

Referring to FIG. 3B, the sinker bar 302 may be substantially similar to the sinker bar 302 of FIG. 3A as including the end grooves 310 and the helical groove 312 extending between the annular end grooves 310. Unlike the sinker bar 302 of FIG. 3A, however, the end grooves 310 in FIG. 3B exhibit an inner diameter $D_5$, which is smaller than the inner diameter $D_4$. In at least one embodiment, for example, the inner diameter $D_4$ may be about 1.25 inches, and the inner diameter $D_5$ may be about 1.125 inches.

Moreover, the end grooves 310 of FIG. 3B may exhibit a radius $R_4$, which may be greater than the radius $R_3$ of the embodiment of FIG. 3A. In at least one embodiment, the radius $R_4$ may be about 0.188 inches but could be more or less than 0.188 inches.

In some embodiments, the helical groove 312 in FIG. 3A exhibits a helical radius $HR_1$, and the helical groove 312 of FIG. 3B exhibits a helical radius $HR_2$. In some embodiments, the helical radius $HR_1$ may be the same as the radius $R_3$, and the helical radius $HR_2$ may be the same as the radius $R_4$. In other embodiments, however, the helical radius $HR_1$ may be different from the radius $R_3$, and the helical radius $HR_2$ may be different from the radius $R_4$.

FIG. 3C depicts juxtaposed side and cross-sectional side views of another example sinker bar 314, according to one or more additional embodiments. The sinker bar 314 may be similar in some respects to the sinker bars 302 of FIGS. 3A-3B, and therefore may be best understood with reference thereto, where like numerals will correspond to like components not described again. The sinker bar 314 includes the body 304 with the generally smooth outer surface 306, and one or more helical grooves 312 are defined in the body 304 and located in the grooved portion 311. Unlike the sinker bars 302 of FIGS. 3A-3B, however, the sinker bar 314 omits the end grooves 310 (FIGS. 3A-3B). Rather, only the helical groove(s) 312 is/are included in the grooved portion 311.

The centralizer 204 is attached to the body 304 at the grooves 312 and extends circumferentially about the body 304 such that it is arranged concentric with the body 304 and covers (encapsulates) the grooves 312. As shown, the opposing first and second centralizer ends 214*a,b* extend axially past the grooved portion 311.

FIG. 3D depicts juxtaposed side and cross-sectional side views of another example sinker bar 316, according to one or more additional embodiments. The sinker bar 316 may be similar in some respects to the sinker bars 302 of FIGS. 3A-3B, and therefore may be best understood with reference thereto, where like numerals will correspond to like components not described again. The sinker bar 316 includes the body 304 with the generally smooth outer surface 306, and a single helical groove 312 defined in the body 304 and located in the grooved portion 311. In the illustrated embodiment, the helical groove 312 comprises helical threading defined on the outer surface 306 of the body 304.

Similar to the sinker bar 314, the sinker bar 316 omits the end grooves 310 (FIGS. 3A-3B), and only the single helical groove 312 is included in the grooved portion 311. Moreover, the centralizer 204 is attached to the body 304 at the groove 312 and extends circumferentially about the body 304 such that it is arranged concentric with the body 304 and covers (encapsulates) the groove 312. As shown, the opposing first and second centralizer ends 214*a,b* extend axially past the grooved portion 311.

FIG. 4A depicts juxtaposed side and cross-sectional side views of another example sinker bar 402, according to one or more additional embodiments of the present disclosure. The sinker bar 402 may be the same as or similar to the sinker bar 130 of FIG. 1, and therefore may be best understood with reference thereto. Accordingly, the sinker bar 402 may be arranged in (form part of) the rod string 126 (FIG. 1) and used as part of the well system 100 (FIG. 1).

As illustrated, the sinker bar 402 comprises a cylindrical, solid body 404 having a generally smooth outer surface 406 and exhibits the outer diameter $D_1$. The body 404 has opposing first and second ends 408*a* and 408*b*, and one or more grooves 410 are defined in the outer surface 406 between the ends 408*a,b*. In the illustrated embodiment, four grooves 410 are defined in the body 404, but more or less than four grooves 410 may be included. In some embodiments, the grooves 410 may be equidistantly (evenly) spaced from each other about the circumference of body 404, but could alternatively be non-equidistantly spaced, without departing from the scope of the disclosure.

In the illustrated embodiment, the grooves 410 are defined in the body 404 and extend axially and parallel with a longitudinal axis $A_1$ of the body 404. In the illustrated embodiment, the sinker bar 402 has four grooves 410 that are angularly offset (spaced) from each other about the circumference of the body 404 along the outer surface 406, and each groove 410 extends axially along a length of the body 404. More or less than four grooves 410 may be included in the sinker bar 402. In some embodiments, the grooves 410 may be equidistantly spaced from each other about the circumference of the body 404. In embodiments with four grooves 410, for example, the grooves 410 may be spaced from each other at 90° intervals. In other embodiments having more or fewer than four grooves, grooves 410 may be spaced closer together or farther apart, such as at 120° intervals for three grooves 410 or 60° intervals for six grooves 410. In other embodiments, however, the grooves 410 may be non-equidistantly spaced from each other.

In some embodiments, two or more of the grooves 410 may be axially aligned along the length of the body 404 such that a midpoint of each groove 410 lies in a plane perpendicular to the axis $A_1$. In other embodiments, however, two or more of the grooves 410 may be axially mis-aligned and otherwise staggered along the length of the body 404.

The grooves 410 may be milled using a radius cutter or another cutting device which can penetrate the outer surface 406 of the body 404 and mill through the material to a uniform depth along the longitudinal axis $A_1$. In applications where a radius cutter is used, this may produce a radiused (curved) bottom in each groove 410. The grooves 410 may alternatively be milled to variable depths along longitudinal axis $A_1$, thereby producing flat bottoms or other shapes and profiles in the grooves 410, without departing from the scope of the disclosure. The grooves 410 may define a groove width $G_W$. As shown, each groove 410 exhibits the same groove width $G_W$ but could alternatively exhibit different widths. In at least one embodiment, the width $G_W$ of the grooves 410 may be about 0.250 inches, but could be more or less than 0.250 inches, without departing from the scope of the disclosure. As illustrated, the length of the grooves 410 is much larger than the groove width $G_W$.

The grooves 410 may each exhibit a groove radius $R_5$ at opposing axial ends of the corresponding groove 410. In some embodiments, each groove 410 exhibits the same radius $R_5$ at opposing ends, but could alternatively exhibit different radii. In at least one embodiment, the radius $R_5$ may be about 0.125 inches, but could be more or less than 0.125 inches, without departing from the scope of the disclosure.

Each groove 410 may provide opposing first and second endpoints 412*a* and 412*b* and may define a grooved portion 414 extending between the end points 412*a,b*. In some embodiments, as shown, each groove 410 may be axially aligned and exhibit the same length. In alternative embodiments, each groove 410 could exhibit different lengths. In such embodiments, the grooved portion 414 may comprise the axial region between the first and second end points 412*a,b*. In at least one embodiment, each groove 410 has the same length, and the end points 412*a,b* at each end of the grooves 410 are provided at the same axial location. In other embodiments, one or more of the grooves 410 may be axially offset from each other such that the end points 412*a,b* do not terminate at the same axial location. In at least one embodiment, the length of the grooved portion 414 may be about 4.00 inches, but could be more or less than 4.00 inches, without departing from the scope of the disclosure. In some embodiments, grooves 410 may have varying lengths.

As shown in the cross-section of FIG. 4A, the centralizer 204 is attached to the body 404 at the location of the grooves 410 and extends circumferentially about the body 404 such that it is arranged concentric with the body 404. The centralizer 204 may be attached to the body 404 such that it covers and otherwise encapsulates the grooves 410. Moreover, the centralizer ends 214*a,b* extend axially past the grooved portion 414 and the end points 412*a,b*.

FIG. 4B depicts juxtaposed side and cross-sectional side views of another example sinker bar 416, according to one or more additional embodiments. The sinker bar 416 may be similar in some respects to the sinker bar 402 of FIG. 4A, and therefore may be best understood with reference thereto, where like numerals will correspond to like components not described again. The sinker bar 416 includes the body 404 with the generally smooth outer surface 406, and one or more grooves 418 are defined in the body 404 and located in the grooved portion 414.

Unlike the sinker bar 402 of FIG. 4A, however, the grooves 418 do not extend axially and parallel with the longitudinal axis $A_1$ (FIG. 4A) of the body 404. Rather, as illustrated, each groove 418 may be defined at least partially helically about the outer circumference of the body 404, but none of the grooves 418 are defined to complete a full revolution (e.g., 360°) about the outer circumference of the body 404. Moreover, in some embodiments, as illustrated, two or more of the grooves 418 may extend substantially parallel to one another. Furthermore, while four grooves 418 are shown in FIG. 4B, more or less than four grooves 418 may be included, without departing from the scope of the disclosure.

Moreover, the centralizer 204 is attached to the body 404 at the grooves 418 and extends circumferentially about the body 404 such that it is arranged concentric with the body 404 and covers (encapsulates) the grooves 418. As shown, the opposing first and second centralizer ends 214*a,b* extend axially past the grooved portion 414.

FIG. 5A shows juxtaposed side and cross-sectional side views of another example sinker bar 502, according to one or more additional embodiments of the present disclosure. The sinker bar 502 may be the same as or similar to the sinker bar 130 of FIG. 1, and therefore may be best understood with reference thereto. Accordingly, the sinker bar 502 may be arranged in (form part of) the rod string 126 (FIG. 1) and used as part of the well system 100 (FIG. 1).

In the illustrated embodiment, the grooves 510 exhibit a generally hemispherical cross-section and may be milled into the outer surface 506 using a radius cutter, thereby producing a radiused (curved) bottom in each groove 510. The hemispherical grooves 510 may alternatively be referred to as "woodruff keyways". In other applications, however, other cutting devices may be used to penetrate the outer surface 506 of the body 504 and mill through the material to a uniform depth along the longitudinal axis $A_1$, thereby producing flat bottoms or other shapes and profiles in one or more of the grooves 510. In such embodiments, this may result in defining a groove width $K_W$, which may be rectangular and uniform along the depth of the groove 510. In at least one embodiment, the groove width $K_W$ may be about 0.25 inches, but may be more or less than 0.25 inches without departing from the scope of the disclosure. In some embodiments, each groove 510 may have different groove widths $K_W$.

As shown from the side view of the sinker bar 502, the grooves 510 may be arcuate and hemispherical in shape, and thus change depth within the body 504 along the longitudinal axis $A_1$. The edges (sides) of the grooves 510, however, may be squared, and thus each groove 510 exhibits a uniform width $K_W$. Each groove 510 may alternatively have variable widths $K_w$ along the length of groove 510, without departing from the scope of the disclosure.

In some embodiments, each groove 510 may define a respective groove length $K_L$, which may be identical to each other, but could alternatively exhibit different groove lengths. In at least one embodiment, the individual groove length K may be about 1.00 inches, but may be more or less than 1.00 inches without departing from the scope of the disclosure. In some embodiments, each groove 510 may have different individual groove lengths $K_L$.

As illustrated, the sinker bar 502 comprises a cylindrical, solid body 504 having a generally smooth outer surface 506 and exhibits the outer diameter $D_1$. The body 504 has opposing first and second ends 508*a* and 508*b*, and the grooves 510 are defined in the outer surface 506 between the ends 508*a,b*. In the illustrated embodiment, four grooves 510 are defined in the body 504, but more or less than four grooves 510 may be included.

As illustrated, the grooves 510 may be defined in the body 504 at various axial locations along the length of the body 504 across a grooved portion 511 of the body 504, beyond which the outer surface 506 of the body 504 remains smooth. In some embodiments, the grooves 510 do not axially overlap with each other. For example, two or more grooves 510 can be axially offset from each other such that no groove 510 axially overlaps another groove 510 along the length of the body 504. In other embodiments, however, two or more of the grooves 510 may axially overlap with each other. Moreover, the grooves 510 may be angularly offset (spaced) from each other about the circumference of the body 504, and may be equidistantly or non-equidistantly spaced from each other. In embodiments with four grooves 510, for instance, the grooves 510 may be angularly spaced from each other at 90° intervals, and also axially spaced from each other. In some embodiments, at least two of the grooves 510 may be aligned in the same plane extending along an axis of the body 504, but angularly offset from each other by 180°.

As shown in the cross-section of FIG. 5A, the centralizer 204 is attached to the body 504 at the location of the grooves 510 and extends circumferentially about the body 504 such that it is arranged concentric with the body 504. More specifically, the centralizer 204 may be attached to the body 504 such that it covers and otherwise encapsulates the grooves 510. As illustrated, the centralizer 204 provides opposing first and second centralizer ends 214*a* and 214*b*, and the centralizer 204 is situated on the body 504 such that the centralizer ends 214*a,b* extend axially past the grooved portion 511.

FIG. 5B depicts juxtaposed side and cross-sectional side views of another example sinker bar 512, according to one or more additional embodiments of the present disclosure. The sinker bar 512 may be similar in some respects to the sinker bar 502 of FIG. 5A, and therefore may be best understood with reference thereto, where like numerals will correspond to like components not described again. As illustrated, the sinker bar 512 includes the body 504 with the generally smooth outer surface 506, and a plurality of the grooves 510 are defined in the body 504 and located in the grooved portion 511.

Unlike the grooves 510 of FIG. 5A, however, which are generally aligned parallel with the longitudinal axis $A_1$ (FIG. 5A) of the body 504, one or more of the grooves 510 in FIG. 5B are defined such that they are angularly offset from the longitudinal axis $A_1$. In some embodiments, two or more of the grooves 510 may be defined such that they are aligned in the same plane or parallel planes. In at least one embodiment, all of the grooves 510 are angularly offset from each other such that none of the grooves 510 are aligned in the same plane or parallel planes.

Moreover, the centralizer 204 is attached to the body 504 at the grooves 418 and extends circumferentially about the body 404 such that it is arranged concentric with the body 404 and covers (encapsulates) the grooves 418. As shown, the opposing first and second centralizer ends 214*a,b* extend axially past the grooved portion 511.

FIG. 5C depicts juxtaposed side and cross-sectional side views of another example sinker bar 514, according to one or more additional embodiments of the present disclosure. The sinker bar 514 may similar in some respects to the sinker bar 502 of FIG. 5A, and therefore may be best understood with reference thereto, where like numerals will correspond to like components not described again. As illustrated, the sinker bar 514 includes the body 504 with the generally smooth outer surface 506, and further includes a plurality of the grooves 516 defined in the body 504 and located in the grooved portion 511.

Unlike the grooves 510 of FIGS. 5A-5B, however, which comprise generally hemispherical, milled out sections (e.g., "woodruff keyways"), the grooves 516 comprise holes or apertures drilled into the body 504. The grooves 516 may be drilled to the same or varying depths. In some embodiments, one or more of the grooves 516 may be defined (drilled) such that the grooves 516 exhibit a generally uniform hole with a uniform diameter and parallel sidewalls. In other embodiments, however, and as shown in FIG. 5C, one or more of the grooves 516 may be defined as variable holes or apertures exhibiting two or more diameters. In some embodiments, two or more of the grooves 516 may be defined such that they are aligned in the same plane or parallel planes. In at least one embodiment, all of the grooves 516 are angularly offset from each other such that none of the grooves 516 are aligned in the same plane or parallel planes.

Moreover, the centralizer 204 is attached to the body 504 at the grooves 418 and extends circumferentially about the body 404 such that it is arranged concentric with the body 404 and covers (encapsulates) the grooves 418. As shown, the opposing first and second centralizer ends 214*a,b* extend axially past the grooved portion 511.

Figure 6D:
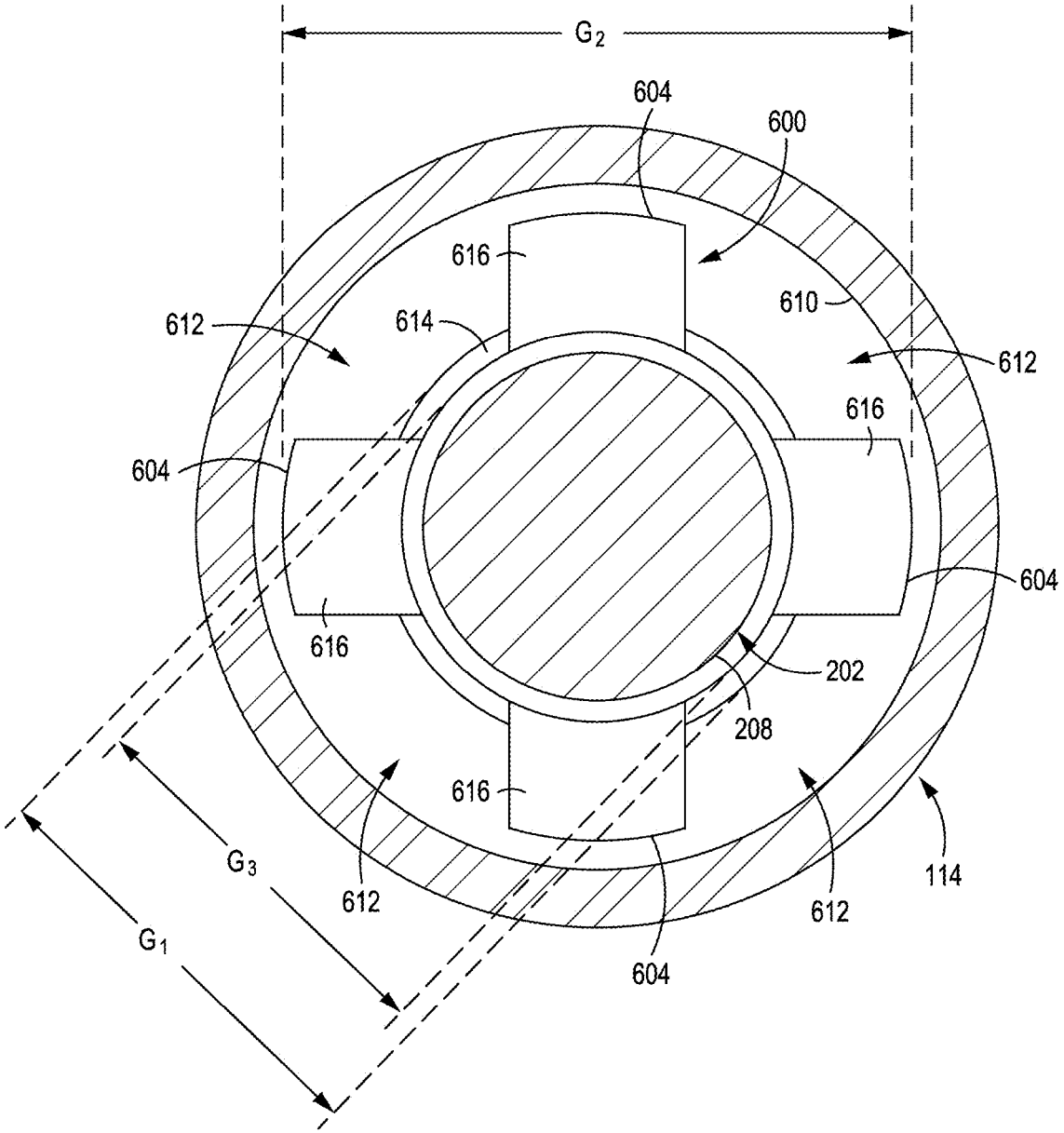
FIG. 6D is a cross-sectional end view of production tubing with the sinker bar of FIGS. 6A-6C disposed therein, according to one or more embodiments.

FIGS. 6A-6D illustrate additional examples of a centralizer 600 that may be used in accordance with the present disclosure. In particular, FIGS. 6A-6C depict juxtaposed side and cross-sectional side views of the sinker bar 202, with the image on the left showing the sinker bar 202 without a corresponding centralizer 600 and the image on the right showing a cross-sectional view of the sinker bar 202 with the centralizer 600 attached thereto. The centralizer 600 may alternatively be attached to the body of any of the other sinker bars 302, 402, 502 described herein.

Referring first to FIG. 6A, the sinker bar 202 is similar to the sinker bar of FIG. 2B, and the centralizer 600 is attached to the body 206 at the grooves 212 and extends circumferentially about the body 206 such that it is arranged concentric with the body 206. The centralizer 600 is attached to the body 206 such that it covers and otherwise encapsulates the three grooves 212.

As illustrated, the centralizer 600 provides opposing first and second centralizer ends 602*a* and 602*b*, and the centralizer 600 is situated on the body 206 such that the centralizer ends 602*a,b* extend axially past the first and last grooves 212 in the series of grooves 212. The centralizer 600 provides an outer radial surface 604 engageable with the inner wall of the production tubing 114 (FIG. 1) when the sinker bar 202 is in the wellbore 108 (FIG. 1). In some embodiments, the outer radial surface 604 extends parallel to the outer surface 208 of the body 206.

The first and second ends 602*a,b* include (provide) opposing first and second transition surfaces 606*a* and 606*b*, respectively, that provide a transition from the outer radial surface 604 to the outer surface 208 of the body 206. As shown, the transition surfaces 606*a,b* are arcuate or curved (e.g., radiused) surfaces that curve (arc) approximately 90° from the outer radial surface 604 to the outer surface 208. In some embodiments, a portion of the transition surfaces 606*a,b* may extend substantially vertically (e.g., perpendicular) from the outer surface 208. In one or more embodiments, the radiused portions of the transition surface 606*a,b* begin transitioning from the outer radial surface 604 within the grooved region 213 and end transitioning (terminate) past (outside of) the grooved region 213 (outside of the first and last grooves 212).

FIG. 6B depicts an additional example embodiment of the sinker bar 202 and the centralizer 600 attached thereto. Unlike the sinker bar 202 of FIG. 6A, the sinker bar 202 in FIG. 6B includes two grooves 212. In the illustrated embodiment, the opposing centralizer ends 602*a* and 602*b* of the centralizer 600 extend axially past the grooved portion 213 of the body 206.

FIG. 6C is another example embodiment of the sinker bar 202 and the centralizer 600 attached thereto, according to one or more additional embodiments of the present disclosure. Unlike the sinker bars 202 of FIGS. 6A and 6B, the sinker bar 202 in FIG. 6C includes only the single groove 212 providing the opposing first and second groove ends 220*a* and 220*b*, thereby defining the grooved portion 213. The sinker bar 202 includes the centralizer 600 attached to the body 206 at the groove 212, and the centralizer 600 extends circumferentially about the body 206 such that it is arranged concentric with the body 206. Moreover, the centralizer 600 is attached to the body 206 such that it covers and otherwise encapsulates the groove 212 and extends past the opposing groove ends 220*a,b* of the groove 212. In embodiments, the transition surfaces 606*a,b* extend into and transition into/from the outer radial surface 604 within the grooved region 213 and between the groove ends 220*a,b*.

FIG. 6D is a cross-sectional end view of the sinker bar 202 of FIGS. 6A-6C disposed along a central axis of the production tubing 114, with the centralizer 600 arranged between the outer surface 208 of the sinker bar 202 and an inner diameter 610 of the production tubing 114, according to one or more embodiments. In one or more embodiments, the outer radial surface 604 of the centralizer 600 extends uninterrupted about the outer surface 208 of the body 206 at a constant diameter (e.g., a solid cylindrical structure). In other embodiments, however, and as seen in FIG. 6D, the outer radial surface 604 may be discontinuous and the centralizer 600 may define a plurality of extensions or "flutes" 612.

As shown, centralizer 600 provides a guide body 614 that exhibits a first diameter $G_1$ and extends continuously about the circumference of the sinker bar 202. The guide body 614 further provides or defines a plurality of lobes 616 spaced from each other about the circumference of the body 206, and corresponding flutes 612 are defined between angularly adjacent lobes 616. Each lobe 616 terminates at the outer radial surface 604 and exhibits a second or outer diameter $G_2$.

In some embodiments, each flute 612 extends from the guide body 614 at a third or inner diameter $G_3$. The inner diameter $G_3$ may be greater than the diameter of the outer surface 208 but less than the diameter $G_2$ of the guide body 614. In other embodiments, each flute 614 extends from the guide body 614 at the first diameter $G_1$. The flutes 614 provide open regions or fluid pathways defined between angularly adjacent lobes 616 and extending radially between the first diameter $G_1$ of the guide body 614 and the inner diameter 610 of the production tubing 114. In such embodiments, the lobes 616 function to centralize the centralizer 600 and the sinker bar 202 within the production tubing 114 while permitting air and other fluids to travel past the centralizer 600 within the flutes 614.

FIG. 6E illustrates an additional example of a centralizer 618 that may be used in accordance with the present disclosure. In particular, FIG. 6E depicts juxtaposed side and cross-sectional side views of the sinker bar 202, where the cross-sectional side views are taken along the lines A-A and B-B, as indicated. As will be appreciated, the centralizer 618 may alternatively be attached to the body of any of the other sinker bars 302, 402, 502 described herein.

As illustrated, the sinker bar 202 is similar to the sinker bar of FIG. 2B, and the centralizer 618 is attached to the body 206 at the grooves 212 and extends circumferentially about the body 206 such that it is arranged concentric with the body 206. The centralizer 618 is attached to the body 206 such that it covers and otherwise encapsulates the grooves 212. Moreover, the centralizer 618 provides opposing first and second centralizer ends 620*a* and 620*b*, and the centralizer 618 is situated on the body 206 such that the centralizer ends 620*a,b* extend axially past the first and last grooves 212 in the series of grooves 212.

Unlike the centralizer 600 of FIGS. 6A-6D, which includes transition surfaces 606*a,b* that are arcuate or curved (e.g., radiused), the centralizer ends 620*a,b* generally taper at an angle until terminating flush with the outer surface of the body 206. Moreover, unlike the centralizer 600, which provides the outer radial surface 604 (FIGS. 6A-6D) that extends uninterrupted and at a constant diameter and defines a plurality of flutes 612 (FIG. 6D), the centralizer 618 may provide or otherwise define a discontinuous or variable outer surface 622. In the illustrated embodiment, for example, the outer surface 622 of the centralizer 618 defines a plurality of angled peaks and valleys, and provides a variety of geometric shapes. Such geometric features provide open regions or fluid pathways that allow fluid flow along the axial length of the sinker bar 202, while simultaneously centralizing the sinker bar 202 within the production tubing 114 (FIG. 1).

Methods of Pretreating Sinker Bars

The sinker bars described herein may be prepared (pretreated) to enhance adhesion with the centralizing guides (centralizers). As noted herein, the centralizing guides may be made of a polymer or plastic material that is injection molded or thermoformed onto the outer surface of a sinker bar, and the outer surface may be pretreated to improve the adhesion of the polymer such that the polymer can be securely attached to the sinker bar without slippage between the guide and the sinker bar. Methods of pretreating sinker bars for adhesion with polymer materials include, but are not limited to, shot peening, knurling, sandblasting, and chemical etching. These methods create a roughened (discontinuous) surface texture or "profile" on the outer surface of the sinker bar that improves the mechanical bonding of the polymer to the steel.

Figure 7A:
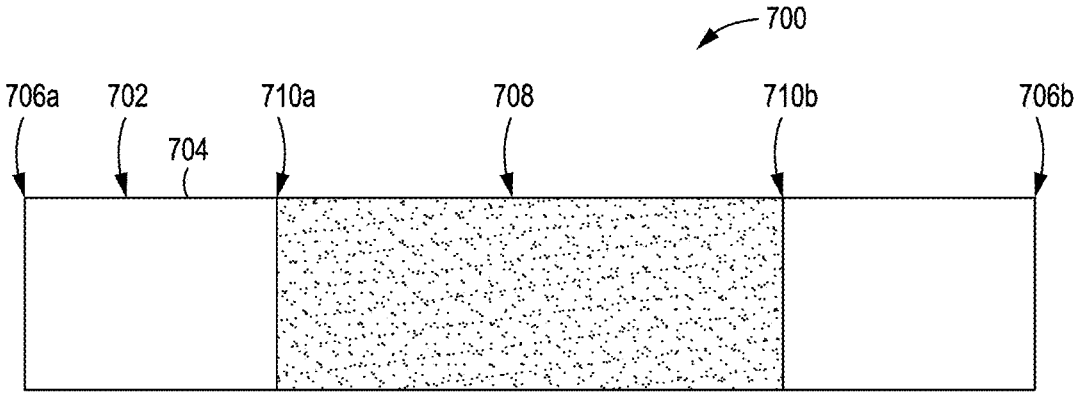
FIGS. 7A-7C are side views of an example pretreated sinker bar, according to one or more methods of the present disclosure.
Figure 7B:
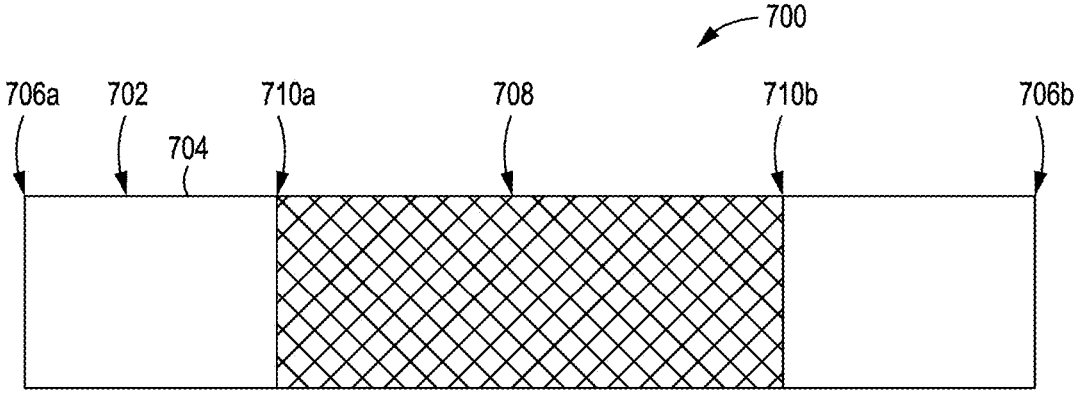
Figure 7C:
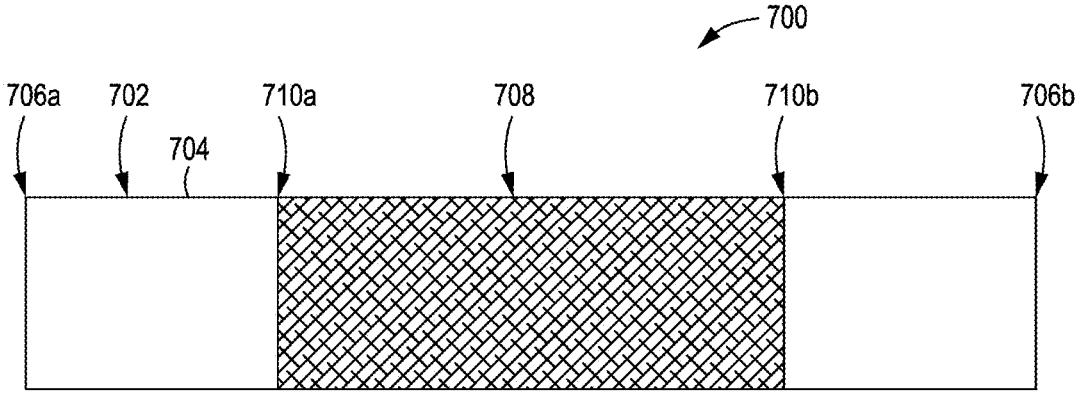

FIGS. 7A-7C are side views of an example sinker bar 700 prepared (pretreated) according to one or more methods of the present disclosure. The sinker bar 700 may be the same as or similar to the sinker bar(s) 130 of FIG. 1, and therefore may form part of the rod string 126 (FIG. 1) and used as part of the well system 100 (FIG. 1). The sinker bar 700 includes a cylindrical, solid body 702 having a generally smooth outer surface 704 and opposing first and second ends 706*a* and 706*b*.

A surface prep region 708 is defined on the outer surface 704 at a location between the first and second ends 706*a,b*. The surface prep region 708 corresponds to a portion of the body 702 at which a centralizer (e.g., centralizers 204, 618) will subsequently be attached. The surface prep region 708 defines first and second prep region ends 710*a* and 710*b*, which may correspond to the ends of the centralizer (e.g., centralizer ends 214*a,b* of FIGS. 2A-5; centralizer ends 620*a,b* of FIGS. 6A-6C). Accordingly, while not shown in FIGS. 7A-7C, one or more grooves (e.g., grooves 212, 310, 312, 410, 516) may be subsequently defined at the surface prep region 708.

In FIG. 7A, the surface prep region 708 is prepared by shot peening the smooth outer surface 704 between the first and second prep region ends 710*a,b*. Shot peening involves bombarding the surface of the sinker bars with small, spherical media at high velocity. This process induces compressive stresses on the surface and creates a uniform, roughened texture that enhances polymer adhesion. The roughened surface provides numerous microscopic anchor points for the polymer, improving the overall bond strength and durability of the coating.

In FIG. 7B, the surface prep region 708 is prepared by knurling the smooth outer surface 704 between the first and second prep region ends 710*a,b*. Knurling involves creating a patterned texture on the surface of the sinker bars by pressing a hardened tool with a specific pattern into the material. This method effectively increases the surface area and introduces a series of ridges and grooves that enhance the mechanical interlocking between the polymer and the sinker bar. The increased surface area and the mechanical interlocking promote better adhesion of the polymer. Knurling can be customized to achieve different patterns and depths, depending on the specific requirements of the polymer coating and the intended application of the sinker bars.

In FIG. 7C, the surface prep region 708 is prepared by sand blasting the smooth outer surface 704 between the first and second prep region ends 710*a,b*. Sand blasting, similar to shot peening, uses abrasive particles propelled at high speed to roughen the surface of the sinker bars. This method effectively removes surface contaminants and creates a textured surface that promotes better adhesion of the polymer. Sand blasting can be adjusted to achieve different levels of surface roughness, depending on the specific requirements of the polymer coating and the intended application of the sinker bars.

The surface prep regions 708 of FIGS. 7A-7C may alternatively be created (prepared) using a variety of chemical preparation methods, such as chemical etching. Chemical etching involves applying a corrosive substance to the surface of the sinker bars to selectively remove material and create a micro-roughened texture. This method effectively cleans the surface by removing contaminants and introduces microscopic pits and valleys that enhance the adhesion of the polymer through both mechanical interlocking and increased surface energy. Chemical etching can be controlled to achieve different levels of surface roughness and etching depth, depending on the specific requirements of the polymer coating and the intended application of the sinker bars.

After pretreating to form the surface prep region 708, the sinker bar 700 may be cleaned to remove any residual abrasive particles or contaminants. The grooves (e.g., grooves 212, 310, 312, 410, 516) may then be defined at the surface prep region 708. In at least one embodiment, the surface prep region 708 extends axially past both axial ends of the grooved portion (e.g., the grooved portions 213, 311, 414). The polymer centralizer (e.g., centralizer 204, 618) is then applied using methods such as injection molding, thermoforming, powder coating, dip coating, or spray coating, and subsequently cured to form a strong, adherent coating. The resulting polymer-coated sinker bars exhibit enhanced durability and performance, even in demanding environments. By employing these pretreatment methods, sinker bars can achieve superior polymer adhesion, ensuring long-lasting protection and functionality in downhole production operations.

Accordingly, pretreating the sinker bars 700 to provide the surface prep region 708 can serve multiple purposes. One purpose is to add mechanical strength to the polymer centralizer, which could be necessary due to the fact the body 702 of the sinker bars 700 typically exhibit a larger diameter than a sucker rod body, which is sometimes guided in the same manner. The larger diameter could result in a reduction in the radial wall thickness of the centralizer on the guided sinker bar 700, which could weaken the mechanical strength of the centralizer to a point that the centralizer would break during well installation or during well operation/maintenance. Pretreating the sinker bars 700 to provide the surface prep region 708, however, may remove a portion of the metal on the body 702 of the sinker bars 700, which is filled (replaced) with the composite material of the centralizer during an injection molding process. As will be appreciated, this can add mechanical strength to the otherwise weakened body profile caused by the increased diameter of the body 702.

Another purpose for pretreating the sinker bars 700 is to lock the centralizer in place so that it does not slide (or move in the longitudinal axis) during well installation or during well operation/maintenance. As described herein, pretreating the grooved areas adds mechanical integrity to the centralizer and helps lock the centralizer in place on the sinker bar 700. Because of a potential reduction in radial wall thickness of the centralizer due to the larger diameter sinker bar 700, there may be concern that the centralizer may not properly secure to the body 702 of the sinker bar 700, and preventing the centralizer from sliding along the body 702 may constitute a primary concern. Pretreating the sinker bars 700 to provide the surface prep region 708, however, helps secure the centralizer to the body 702 without adding significant structural integrity to the guide profile.

Embodiments disclosed herein include:

A. A sinker bar includes a cylindrical body having an outer surface and opposing first and second ends, one or more grooves defined in the outer surface between the first and second ends and thereby defining a grooved portion of the body, and a centralizer attached to the body at the grooved portion and encapsulating the one or more grooves, the centralizer providing opposing first and second centralizer ends extending axially beyond opposing axial ends of the grooved portion.

B. A well system includes a pumping unit, a wellhead arranged adjacent the pumping unit and above a wellbore, and a rod string operatively coupled to the pumping unit and extending through the wellhead into the wellbore. The rod string includes a plurality of sucker rods, a submersible pump arranged at a distal end of the plurality of sucker rods, and a sinker bar interposing the plurality of sucker rods and the submersible pump. The sinker bar includes a cylindrical body having an outer surface and opposing first and second ends, one or more grooves defined in the outer surface between the first and second ends and thereby defining a grooved portion of the body, and a centralizer attached to the body at the grooved portion and encapsulating the one or more grooves, the centralizer providing opposing first and second centralizer ends extending axially beyond opposing axial ends of the grooved portion.

Each of embodiments A and B may have one or more of the following additional elements in any combination: Element 1: wherein each groove is defined circumferentially about the outer surface of the body. Element 2: wherein the one or more grooves comprise a plurality of grooves and each groove is axially offset and arranged parallel to each other. Element 3: wherein the centralizer provides an outer radial surface extending parallel to the outer surface of the body, and wherein each centralizer end provides a transition surface that transitions from the outer radial surface to the outer surface of the body. Element 4: wherein the transition surface is selected from the group consisting of straight, curved, arcuate, progressively varying, and any combination thereof. Element 5: wherein the one or more grooves includes an elongated groove extending parallel to a longitudinal axis of the body. Element 6: wherein a length of the elongated groove is larger than a width of the elongated groove. Element 7: wherein the one or more grooves comprise at least one helical groove. Element 8: wherein the one or more annular grooves comprise two annular grooves axially spaced from each other and at least one helical groove extending between the two annular grooves. Element 9: wherein the one or more grooves each exhibit a hemispherical cross-section. Element 10: wherein the one or more grooves are angularly offset from each other about the circumference of the body. Element 11: wherein the centralizer includes a guide body, a plurality of lobes extending radially outward from the guide body and defining an outer radial surface of the centralizer, and a flute defined between angularly adjacent lobes of the plurality of lobes. Element 12: further comprising a surface prep region defined on the outer surface between the first and second ends and extending axially past the opposing axial ends of the grooved portion. Element 13: wherein the surface prep region is prepared by at least one of shot peening, knurling, sand blasting, chemical etching, and any combination thereof.

Element 14: wherein each groove is defined circumferentially about the outer surface of the body. Element 15: wherein the centralizer provides an outer radial surface extending parallel to the outer surface of the body, and wherein each centralizer end provides a transition surface that transitions from the outer radial surface to the outer surface of the body. Element 16: wherein the one or more grooves includes an elongated groove extending parallel to a longitudinal axis of the body, and wherein a length of the elongated groove is larger than a width of the elongated groove. Element 17: wherein the one or more grooves comprise at least one helical groove. Element 18: wherein the centralizer includes a guide body, a plurality of lobes extending radially outward from the guide body and defining an outer radial surface of the centralizer, and a flute defined between angularly adjacent lobes of the plurality of lobes.

By way of non-limiting example, exemplary combinations applicable to A, B, and C include: Element 1 with Element 2; Element 3 with Element 4; Element 5 with Element 6; Element 9 with Element 10; and Element 12 with Element 13.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A sinker bar, comprising:

a cylindrical body having an outer surface and opposing first and second ends, the outer surface exhibiting a first diameter;

one or more grooves defined in the outer surface between the first and second ends and thereby defining a grooved portion of the body, at least one of the one or more grooves exhibiting a second diameter smaller than the first diameter; and a centralizer attached to the body at the grooved portion and encapsulating the one or more grooves, the centralizer providing opposing first and second centralizer ends extending axially beyond opposing axial ends of the grooved portion and terminating at the outer surface.

2. The sinker bar of claim 1, wherein each groove of the one or more grooves is defined circumferentially about the outer surface of the body.

3. The sinker bar of claim 2, wherein the one or more grooves comprise a plurality of grooves and each groove is axially offset and arranged parallel to each other.

4. The sinker bar of claim 1, wherein the centralizer provides an outer radial surface extending parallel to the outer surface of the body, and wherein each centralizer end provides a transition surface that transitions from the outer radial surface to the outer surface of the body.

5. The sinker bar of claim 4, wherein the transition surface is selected from the group consisting of straight, curved, arcuate, progressively varying, and any combination thereof.

6. The sinker bar of claim 1, wherein the one or more grooves includes an elongated groove extending parallel to a longitudinal axis of the body.

7. The sinker bar of claim 1, wherein the one or more grooves comprise at least one helical groove.

8. The sinker bar of claim 1, wherein the one or more grooves comprise two annular grooves axially spaced from each other and at least one helical groove extending between the two annular grooves.

9. The sinker bar of claim 1, wherein the centralizer includes:

a guide body;

a plurality of lobes extending radially outward from the guide body and defining an outer radial surface of the centralizer; and a flute defined between angularly adjacent lobes of the plurality of lobes.

10. The sinker bar of claim 1, further comprising a surface prep region defined on the outer surface between the first and second ends and extending axially past the opposing axial ends of the grooved portion.

11. The sinker bar of claim 10, wherein the surface prep region is prepared by at least one of shot peening, knurling, sand blasting, chemical etching, and any combination thereof.

12. A sinker bar, comprising:

a cylindrical body having an outer surface and opposing first and second ends;

one or more grooves defined in the outer surface between the first and second ends and thereby defining a grooved portion of the body; and a centralizer attached to the body at the grooved portion and encapsulating the one or more grooves, the centralizer providing opposing first and second centralizer ends extending axially beyond opposing axial ends of the grooved portion, wherein the one or more grooves includes an elongated groove extending parallel to a longitudinal axis of the body, and wherein a length of the elongated groove is larger than a width of the elongated groove.

13. A sinker bar, comprising:

a cylindrical body having an outer surface and opposing first and second ends;

one or more grooves defined in the outer surface between the first and second ends and thereby defining a grooved portion of the body; and a centralizer attached to the body at the grooved portion and encapsulating the one or more grooves, the centralizer providing opposing first and second centralizer ends extending axially beyond opposing axial ends of the grooved portion, wherein the one or more grooves each exhibit a hemispherical cross-section.

14. The sinker bar of claim 13, wherein the one or more grooves are angularly offset from each other about the circumference of the body.

15. A well system, comprising:

a pumping unit;

a wellhead arranged adjacent the pumping unit and above a wellbore;

a rod string operatively coupled to the pumping unit and extending through the wellhead into the wellbore, the rod string including a plurality of sucker rods, a submersible pump arranged at a distal end of the plurality of sucker rods, and a sinker bar interposing the plurality of sucker rods and the submersible pump, the sinker bar including:

a cylindrical body having an outer surface and opposing first and second ends the outer surface exhibiting a first diameter;

one or more grooves defined in the outer surface between the first and second ends and thereby defining a grooved portion of the body, at least one of the one or more grooves exhibiting a second diameter smaller than the first diameter; and a centralizer attached to the body at the grooved portion and encapsulating the one or more grooves, the centralizer providing opposing first and second centralizer ends extending axially beyond opposing axial ends of the grooved portion and terminating at the outer surface.

16. The well system of claim 15, wherein each groove of the one or more grooves is defined circumferentially about the outer surface of the body.

17. The well system of claim 15, wherein the centralizer provides an outer radial surface extending parallel to the outer surface of the body, and wherein each centralizer end provides a transition surface that transitions from the outer radial surface to the outer surface of the body.

18. The well system of claim 15, wherein the one or more grooves includes an elongated groove extending parallel to a longitudinal axis of the body.

19. The well system of claim 15, wherein the one or more grooves comprise at least one helical groove.

20. The well system of claim 15, wherein the centralizer includes:

a guide body;

a plurality of lobes extending radially outward from the guide body and defining an outer radial surface of the centralizer; and a flute defined between angularly adjacent lobes of the plurality of lobes.

* * * * *